US005755246A

United States Patent [19]

Carl et al.

[11] Patent Number: 5,755,246

[45] Date of Patent: May 26, 1998

[54] HOUSING FOR INDUSTRIAL FINISHING EQUIPMENT

[75] Inventors: David W. Carl, Posonville; Steven W. Kercher, Evansville; Larry J. Schenk, Mt. Vernon; Greg M. Wallace, Evansville; J. Steve Whitehead, Newburgh, all of Ind.

[73] Assignee: George Koch Sons, Inc., Evansville, Ind.

[21] Appl. No.: 494,032

[22] Filed: Jun. 23, 1995

[51] Int. Cl.[6] ..... B08B 15/02

[52] U.S. Cl. ..... 134/73; 134/131; 134/199; 134/200; 312/228

[58] Field of Search ..... 134/70, 71, 124, 134/200, 131, 199, 73; 118/326, 322, DIG. 7; 198/860.1, 860.3, 860.5; 312/228; 454/50

[56] References Cited

U.S. PATENT DOCUMENTS

| | | | |
|---|---|---|---|
| 2,279,686 | 4/1942 | Kerlin | 118/DIG. 7 |
| 2,490,289 | 12/1949 | Williams, Jr. et al. . | |
| 2,693,353 | 11/1954 | Vaughan . | |
| 2,721,564 | 10/1955 | Kearney | 134/199 |
| 3,076,401 | 2/1963 | Djadjich . | |
| 3,213,472 | 10/1965 | Cocchiaraley et al. . | |
| 3,226,947 | 1/1966 | Wakatsuki et al. . | |
| 3,443,568 | 5/1969 | Janiszewski . | |
| 3,468,320 | 9/1969 | Cumming . | |
| 3,591,985 | 7/1971 | Coppins . | |
| 3,706,317 | 12/1972 | Fox et al. . | |
| 3,824,912 | 7/1974 | Jensen et al. . | |
| 3,827,262 | 8/1974 | Manuel . | |
| 3,902,455 | 9/1975 | Lehmann et al. | 118/DIG. 7 |
| 3,942,420 | 3/1976 | Marino | 118/DIG. 7 |
| 4,207,833 | 6/1980 | Napadow | 118/DIG. 7 |
| 4,281,675 | 8/1981 | Pure . | |
| 4,338,958 | 7/1982 | Fujita . | |
| 4,506,687 | 3/1985 | Rosch, III . | |
| 4,600,608 | 7/1986 | Ankrett | 118/DIG. 7 |
| 4,732,173 | 3/1988 | Czaja et al. . | |
| 5,253,665 | 10/1993 | Guirl . | |

FOREIGN PATENT DOCUMENTS

| | | |
|---|---|---|
| 4-313417 | 11/1992 | Japan . |
| 6-10160 | 1/1994 | Japan . |

OTHER PUBLICATIONS

EPO(Eurpoean Patent Office)596,820 May 1994.

"Eliminate Costly Steel door Failure Forever"!, Chem-Pruf® Door Co. advertisement, Plant Services, Nov., 1994, p. 85.

"American Composites Patriot Washer", American Composites, Inc. advertisement, Jun. 5, 1992 solicitation.

"The Surface Advantages", American Composites, Inc. advertisement, Jun. 5, 1992 solicitation.

"Dip Phosphate System," specification from Ford, Jan. 15, 1994, part 20.15 FRP Enclosure, Body and Assembly Operations, Section 300.

*Primary Examiner*—Frankie L. Stinson

*Attorney, Agent, or Firm*—Barnes & Thornburg

[57] ABSTRACT

A housing is provided for use in an industrial finishing equipment station. The housing includes housing wall panels, each having a top edge, a bottom edge, and two spaced-apart sides therebetween and a flange that is appended to the top and side edges. In addition, a clamp having flange-engaging portions is mounted upon the flanges appended to the top edges of the housing wall panels to couple the housing wall panels together. The housing wall panels are positioned to lie in opposing rows and cooperate to define a tunnel-like passageway workspace therebetween through which work pieces can pass.

44 Claims, 5 Drawing Sheets

10
14
18
20
21
22
23
24
25
26
28
30
34
36
38
40
42
44
46
48
51
53
54
56
58
60
62
80
82
83
86
88
90
92
100
102
104
106
108
109
110
111
112
114
116
128

HOUSING FOR INDUSTRIAL FINISHING EQUIPMENT

BACKGROUND AND SUMMARY OF THE INVENTION

The present invention relates to industrial finishing equipment, and particularly to a housing for use with industrial finishing equipment. More particularly, the present invention relates to a housing for use on an industrial washer that can stand alone or that can be installed in-line with industrial finishing equipment, the washer being used to prepare the surfaces of work pieces being finished by the finishing equipment.

In recent years, several changes in the industrial finishing business environment have escalated the demands on surface preparation processes and equipment. For instance, EPA restrictions on the use of volatile organic compounds have resulted in the increased use of water based and powder coating paints which, unlike solvent based coatings, do not easily bond to contaminated surfaces. Additionally, customers' continuously increasing quality expectations demand that surface finishes, which are typically readily observable and which provide a customer with a first impression of the quality of the workmanship in a device, are clean and free of contaminants.

These needs have resulted in cleaning processes of lengthening durations. Additionally, the use of chemical cleaning agents such as various alkalies, phosphates, and acids, all used at various temperatures, is common, and the use of deionized water in final rinses has grown in popularity. Many of these chemical cleaning agents as well as deionized water are corrosive and some washers are susceptible to damage from these treatments. Corrosion related problems associated with washers installed in-line with finishing equipment are documented, for example, in U.S. Pat. No. 5,253,665 to Guirl which discloses one washer for integration into industrial finishing operations.

What is needed is a washer for use with industrial finishing equipment that will not significantly corrode after extended exposure to deionized water and chemical cleaning agents, that can accommodate various solution temperatures with no problems arising due to stresses caused by differing coefficients of expansion of adjoining parts, and that is easy to install yet is flexible in design so that the washer may be customized to accommodate the needs of users' varied finishing processes.

Additionally, those responsible for industrial finishing operations would appreciate a washer having a housing that requires very little maintenance while manufacturers would appreciate a washer having a housing with a minimal number of assembly parts.

According to the present invention, a housing for a station installed in-line with industrial finishing equipment is provided. The housing includes a plurality of housing wall panels, each housing wall panel having a perimetral edge. A flange is appended to the perimetral edge of each housing wall panel. The housing wall panels are positioned in two opposing rows and are arranged to cooperate to define a tunnel-like passageway workspace therebetween through which work pieces can pass.

In preferred embodiments, each housing wall panel includes a roof panel having a top edge, the roof panel lying in a first plane, and a bottom panel lying in a second plane. The first plane and the second plane are not coplanar, and the roof panel, the side panel, and the flange are of unitary construction and are made from a plastic material.

In addition, the housing includes first and second housing wall panels, the first housing wall panel being a left-handed housing wall panel positioned on the left side of the housing. The second housing wall panel is a right-handed housing wall panel positioned on the right side of the housing opposing the first housing wall panel. Illustratively, left-handed housing wall panels are identical to right-handed housing wall panels but are positioned on the opposite side of the housing. Although the illustrative left-handed and right-handed housing wall panels are of identical construction, it is within the scope of the invention as presently perceived to provide left-handed housing wall panels that are not identical to the right-handed housing wall panels, so long as all housing wall panels are provided with structural features described herein.

The right-handed and left-handed housing wall panels are arranged so that the flange adjacent to the top edge of the left-handed housing wall panel is positioned to lie adjacent to the flange adjacent to the top edge of the right-handed housing wall panel. The housing further includes means connected to the finishing equipment for fixing the left-handed panel relative to the right-handed housing wall panel.

In one preferred embodiment, the finishing equipment includes a conveyor rail and the fixing means is appended to the conveyor rail. The fixing means includes means for clamping the housing wall panel to the conveyor rail without penetrating the housing wall panel. The clamping means includes a clamp bar having a flange-engaging portion arranged to engage the flange adjacent to the top edge of a housing wall panel. The clamp bar also has a conveyor rail-engaging portion and means appended to the conveyor rail-engaging portion for fixing the clamp bar to the conveyor rail.

Advantageously, the conveyor rail is formed to include first fastener-receiving holes and the conveyor rail-engaging portion of the clamp bar is formed to include second fastener-receiving holes arranged to align with the first fastener-receiving holes. This permits threaded fasteners to be received by the first and second fastener-receiving holes to fix the clamp bar to the conveyor rail.

In another embodiment, the finishing equipment includes an elongated conveyor rail and the housing includes first and second external frame members. The external frame members are positioned to lie in spaced-apart relation with the conveyor rail positioned to lie therebetween. The first housing wall panel is connected to the first frame member and the second housing wall panel is connected to the second frame member. The housing wall panels are arranged so that the flange adjacent to the top edge of the first housing wall panel engages the first frame member and the flange adjacent to the top edge of the second housing wall panel engages the second frame member. The housing further includes means appended to the external frame members for clamping the housing wall panels to the external frame members without penetrating the housing wall panels.

The fixing means includes a first clamp bar connected to the first frame member and a second clamp bar connected to the second frame member. The first clamp bar has a housing wall panel-engaging portion in engagement with the flange adjacent to the top edge of the first housing wall panel, and the second clamp bar has a housing wall panel-engaging portion in engagement with the flange adjacent to the top edge of the second housing wall panel A first elongated rub bar is appended to the first frame member and a second elongated rub bar is appended to the second frame member. The first and second rub bars are arranged in spaced-apart parallel relation to define an elongated gap therebetween. The gap is arranged to permit the ingress of a work piece suspended from a roller assembly into the washer.

Each housing wall panel is preferably a unitary piece formed to include a planar bottom panel having a top edge and a curved shoulder panel. The curved shoulder panel includes a bottom edge and a top edge positioned to lie in spaced-apart parallel relation to the bottom edge of the shoulder panel. The bottom edge of the shoulder is appended to the top edge of the bottom panel. Each housing wall panel further includes a planar roof panel having a bottom edge appended to the top edge of the shoulder panel.

Each housing wall panel is configured with the bottom panel positioned to lie in a first plane and the roof panel positioned to lie in a second plane. The first and second planes are neither parallel nor are the first and second planes perpendicular. Advantageously, the roof panel is positioned to lie at an angle of greater than 90 degrees to the bottom panel to reduce the cross-sectional area of the housing and thereby reduce energy loss through the housing, as well as to assist the run-off of solution from the housing wall panel.

The bottom panel is formed to include two spaced-apart side edges, the shoulder is formed to include two spaced-apart side edges, and the roof panel is formed to include a top edge and two spaced-apart side edges. The side edges of the bottom panel, the side edges of the shoulder, the side edges of the roof panel and the top edge of the roof panel cooperate to define a perimetral edge of the housing wall panel. A flange is appended to the perimetral edge, and the bottom panel, the shoulder, the roof panel, and the flange are of unitary construction.

Advantageously, the flanges provide structural integrity to the housing wall panels so that the housing requires no internal support frame. Additionally, the flange provides a site for clamping conduit and other exterior devices as well as a surface to support insulation on the housing, over which an exterior cover may be applied. The flange also serves as a connection point for expansion joints.

A drain board panel can be provided in the housing. Each housing wall panel further includes a drain board-receiving portion adjacent to the bottom edge, and the drain board-receiving portion can be appended to the drain board panel. The station can further include a frame positioned below the housing and the drain board panel can rest on the frame.

As described above, each housing wall panel includes a bottom panel that is generally planar. The housing can be provided with a silhouette panel that can be appended to the housing wall panels. The silhouette panel is then positioned to lie in orthogonal relation to the bottom panels of the opposing housing wall panels.

The first housing wall panel includes first and second spaced-apart sides and the second housing wall panel includes first and second spaced-apart sides. In addition, the housing can be formed to further include a third housing wall panel having a top edge, a perimetral edge, a flange appended to the perimetral edge, and first and second spaced-apart sides. The third housing wall panel can be arranged in side-by-side relation to the first housing wall panel. When in side-by-side relation, the flange of the third housing wall panel adjacent to the first side of the third housing wall panel can be appended to the flange of the first housing wall panel adjacent to the second side of the first housing wall panel.

The housing can be formed to further include a fourth housing wall panel having a top edge, a perimetral edge, a flange appended to the perimetral edge, and first and second spaced apart sides. The fourth housing wall panel can be arranged in side-by-side relation to the second housing wall panel having the flange of the fourth housing wall panel adjacent to the first side of the fourth housing wall panel appended to the flange of the second housing wall panel adjacent to the second side of the second housing wall panel. Additional housing wall panels can be added to the housing in this manner to provide a housing of nearly any length desired by a user of industrial finishing equipment.

Typically, when housing wall panels are in the side-by-side configuration, the joints connecting the sides of the panels provide a continuous interior surface to the housing. Advantageously, the smooth interior surface allows silhouette panels, pipe supports, stiffeners, and any other necessary item to be easily located and assembled inside the housing. These internal components can be fixed to the housing using a fiberglassing resin to provide a weld-like connection. Additionally, the smooth interior facilitates washing the interior walls of the washer.

Housing wall panels can be formed to include openings configured to receive corrosion-resistant fiberglass doors that allow ingress to and egress from the inside of fiberglass washers. Rather than mounting a separate door frame to an opening in the housing wall panel, a fiberglass door frame can be integrally appended to the housing wall panel, thereby reducing the number of potential sites that can develop leaks. Advantageously, a frame, preferably made from fiberglass, that is separate from a housing wall panel can be formed. This separate frame allows a fiberglass door to be mounted to an opening in a wall made from a material other than fiberglass, thereby allowing fiberglass doors to be used on non-fiberglass washers.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Industrial finishing equipment typically includes a continuous conveyor configured to suspend and pass work pieces to be finished, typically fabricated metal articles, in front of work stations designed to complete various finishing tasks on the work pieces. The conveyor is arranged to transport the work pieces to various work stations that can be arranged in an "in-line" manner to facilitate continuous operation of the conveyor and continuous movement of the work pieces. The "in-line" configuration typically includes closely spaced work stations arranged so that finishing operations are performed on the work pieces in rapid progression. Industrial finishing equipment work stations, however, can also be made to stand alone as individual work stations.

Among the tasks to be performed on work pieces is work piece washing, both prior to finishing and, in some cases, after finishing the work pieces. Both governmental restrictions and ever increasing customer quality expectations continue to increase the complexity of surface washing processes which typically include multiple cleaning and rinsing stages. These complex processes in turn raise the demands on the cleaning equipment. Manufacturers involved in industrial finishing have a substantial and growing need for simple, flexible, and durable washing stations.

Figure 1:
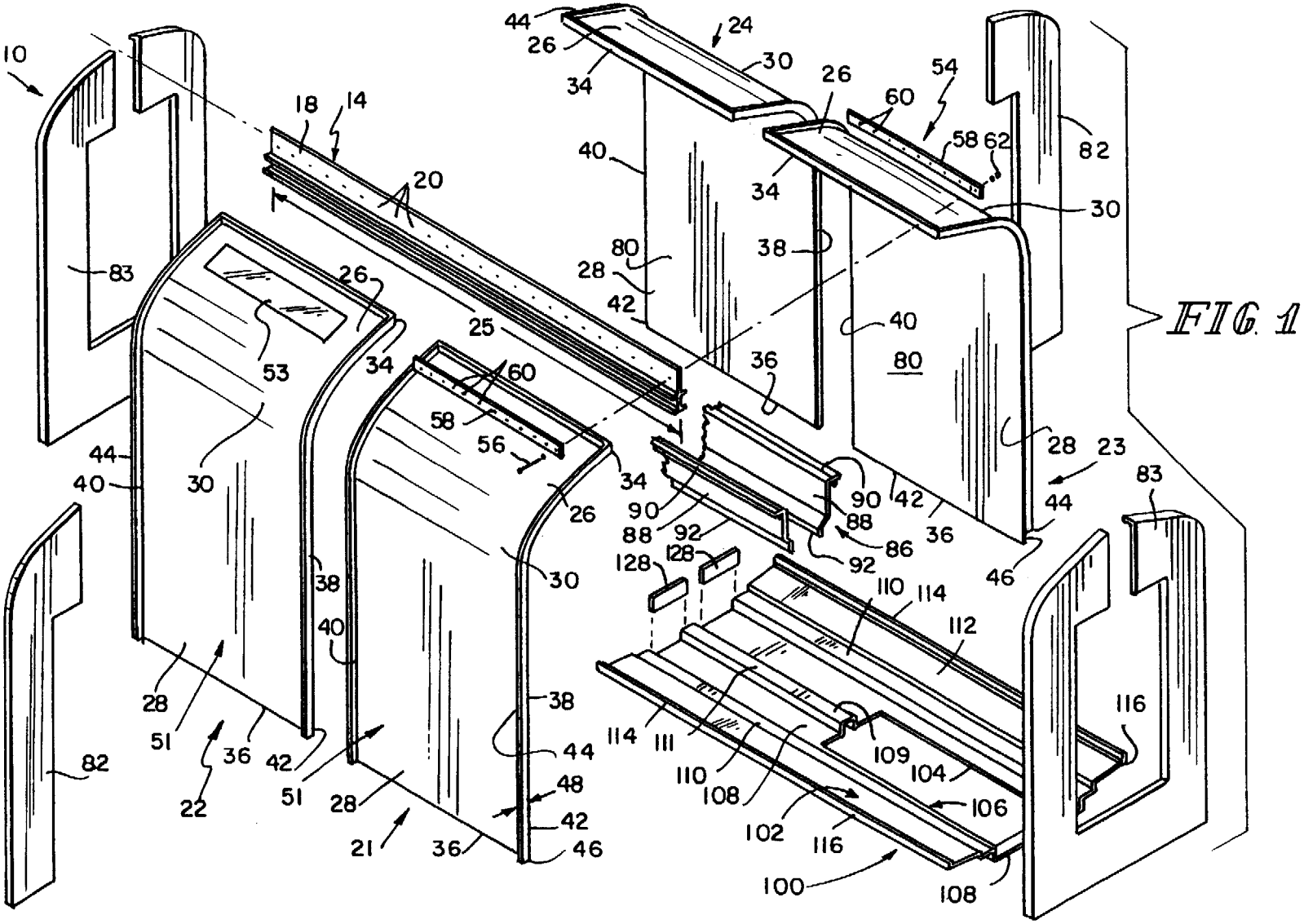
FIG. 1 is an exploded perspective view of a housing in accordance with the present invention showing an elongated conveyor rail formed to include a plurality of spaced-apart holes along a top portion of the rail, four arched housing wall panels aligned in pairs on each side of the conveyor rail, two elongated clamp bars positioned adjacent to the tops of the housing wall panels and arranged to engage the conveyor rail, a drain board panel positioned to lie under the housing wall panels and beneath the conveyor rail, two conveyor guards positioned to lie in close proximity to the conveyor rail, two U-shaped end panels positioned across from the ends of the conveyor rail, and two silhouette panels positioned to mount against the walls inside of the housing.
Figure 2:
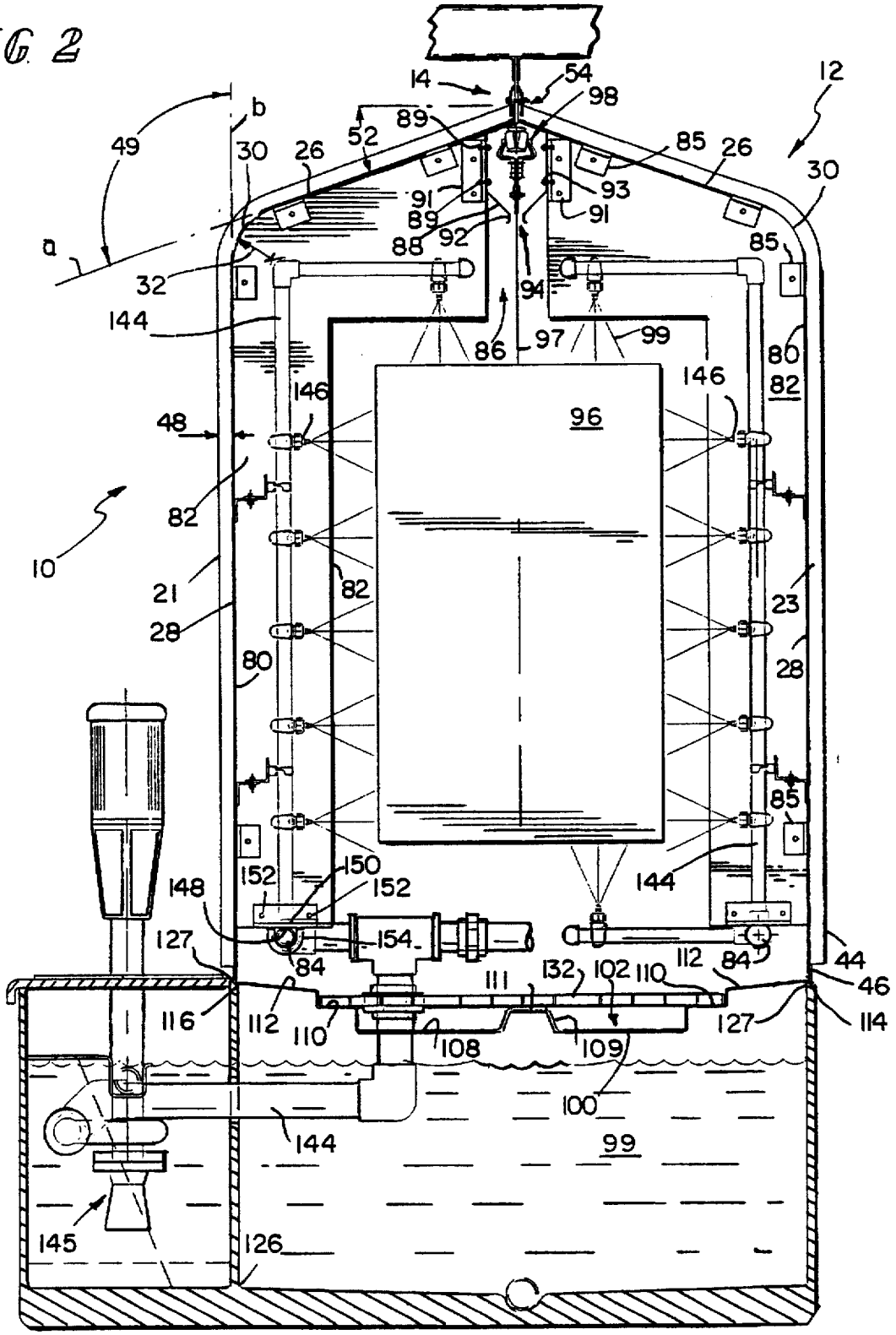
FIG. 2 is an end elevation view of the housing of FIG. 1 showing the housing resting on top of a tank containing washing solution, a rectangular work piece to be cleaned hanging from a roller assembly carried on the conveyor rail, and pipes having spray nozzles spraying washing solution onto the work piece.
Figure 3:
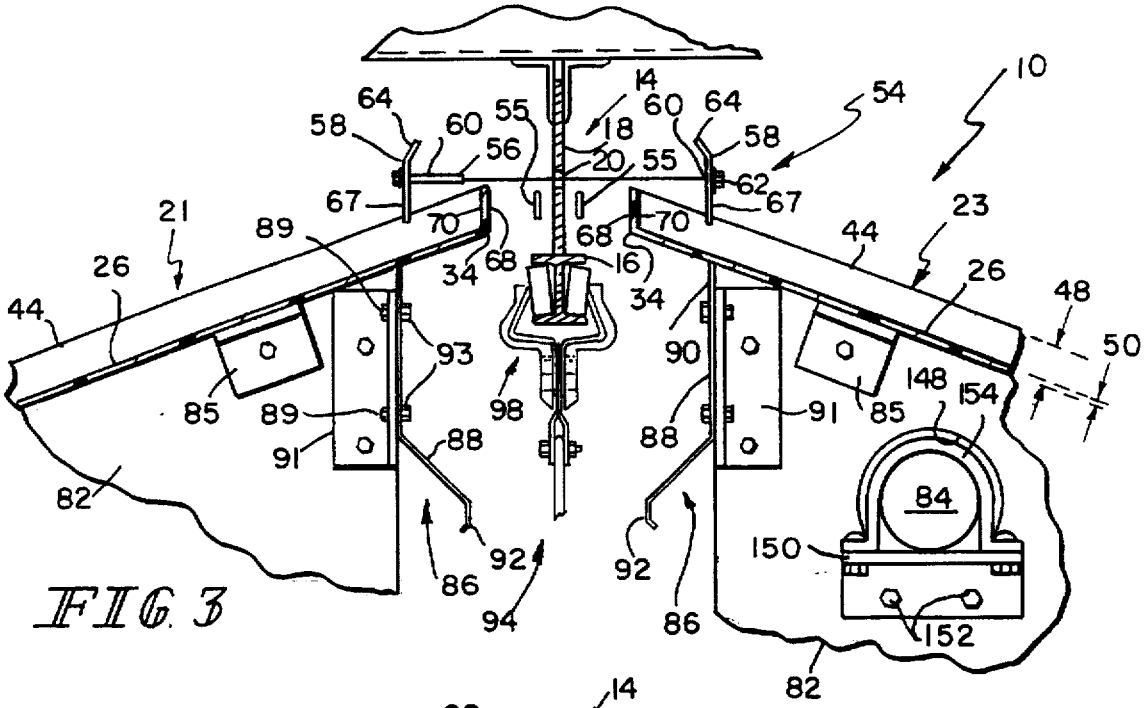
FIG. 3 is an enlarged exploded end elevation view of a portion of the washer of FIG. 2 showing the roller assembly engaging the conveyor rail which is attached to an external frame, two housing wall panels positioned to be clamped to the conveyor rail by clamping assemblies, and two downwardly extending conveyor guards appended to the housing wall panels and positioned to partially enclose the conveyor rail and the roller assembly.
Figure 4:
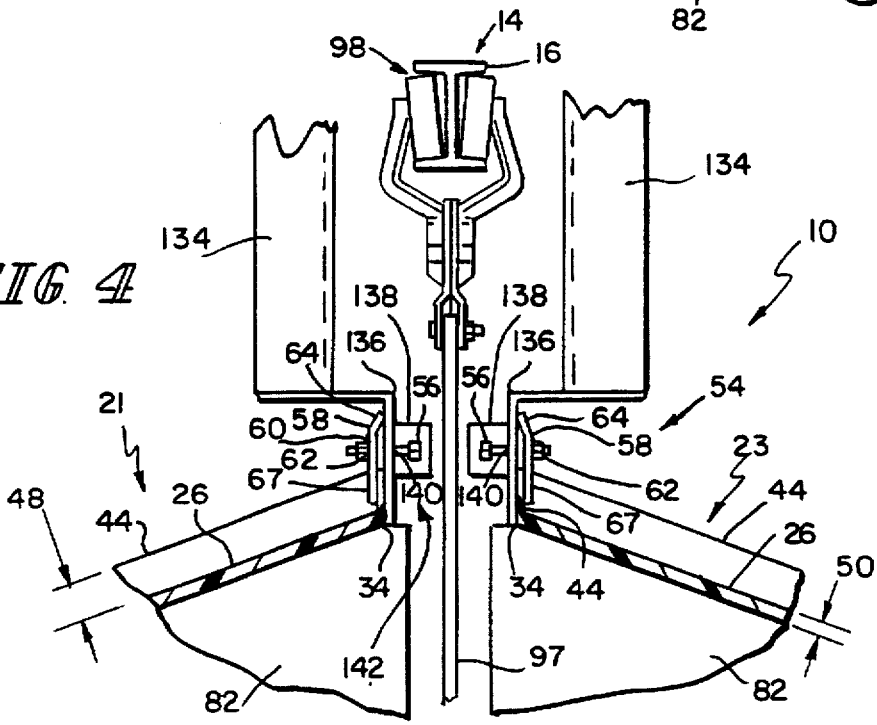
FIG. 4 is a view similar to FIG. 3 of a second embodiment of the housing showing the first housing wall panel appended to a first downwardly extending frame member, the second housing wall panel appended to a second downwardly extending frame member, the conveyor rail appended to a third downwardly extending frame member, the first and second housing members being arranged in spaced-apart relation to provide an elongated gap therebetween to allow passage of the work piece suspended from a line appended to the roller assembly.

A first embodiment of a housing 10 for a washer 12 designed to be either installed in-line with other industrial finishing equipment (not shown) or to be installed as a stand-alone piece is illustrated in FIGS. 1–3, and a second embodiment is illustrated in FIG. 4. The housing 10 is attached to an elongated conveyor rail 14 having a roller track 16 positioned beneath an elongated mounting bar 18 illustrated in FIG. 1. The mounting bar 18 is formed to include a plurality of mounting holes 20 spaced-apart along the length of the mounting bar 18.

Housing wall panels 21, 22, 23, 24 are attached to the conveyor rail 14 as shown, for example, in FIG. 2. Though the illustrative embodiment of FIG. 1 shows a housing 10 having four housing wall panels 21, 22, 23, 24, it is within the scope of the invention as presently perceived to provide a housing 10 having as few as two housing wall panels 21, 23 and as many housing wall panels 21, 22, 23, 24 as desired to provide a washer 12 having sufficient length 25 to meet the needs of a users' customized washing processes.

Illustratively, each housing wall panel 21, 22, 23, 24 is of identical construction. However, it is within the scope of the invention as presently perceived to provide housing wall panels 21, 22, 23, 24 of varying construction so long as housing wall panels 21, 22, 23, 24 include the features described herein. For illustrative purposes, left-handed housing wall panels 21, 22 are positioned on the left side of the housing and the right-handed housing wall panels 23, 24 are positioned on the right side of the housing and are arranged to oppose the left-handed housing wall panels as shown, for example, in FIG. 1. Additionally, the first and second housing wall panels 21, 23 are positioned in side-by-side relation to the third and fourth housing wall panels 22, 24.

Each housing wall panel 21, 22, 23, 24 includes a roof panel 26, a bottom panel 28, and a shoulder 30 interconnecting the roof panel 26 and the bottom panel 28. The roof panel 26 of illustrative housing wall panel 21 is planar and lies along a plane indicated by line a as shown in FIG. 2. The bottom panel 28 is also illustratively planar and lies along a plane indicated by line b (planes a and b extend perpendicular to the page in the illustration) as shown in FIG. 2.

The roof panels 26 are arranged to have a slope so that the roof panels 26 are positioned to lie at an angle 49 other than a right angle to the bottom panel 28. The shoulder 30 is produced with a curvature of a predetermined radius 32 as shown in FIG. 2. Satisfactory results have been achieved producing housing wall panels 21, 22, 23, 24 having radius 32 of eight inches. Theoretically, housing wall panels 32 can be produced having radius 32 ranging from nearly zero inches to any desired large radius, however practicality presently dictates that radius 32 is between about ¼ inch and about 30 inches.

Each housing wall panel 21, 22, 23, 24 is formed to include a top edge 34, a bottom edge 36 positioned to lie in spaced-apart relation to the top edge 34, a first side edge 38, and a second side edge 40 positioned to lie in parallel spaced-apart relation to the first side edge 38 as illustrated in FIG. 1. The top edge 34, bottom edge 36, first side edge 38, and second side edge 40 cooperate to define a perimetral edge 42. An outwardly-extending flange 44 is appended to the perimetral edge 42. Though the flange 44 can be formed to encircle the entire perimetral edge 42 of each housing wall panel 21, 22, 23, 24, satisfactory results have been achieved by appending the flange 44 to only the top edge 34 and both side edges 38, 40. The bottom edge 36 and a drain board-receiving portion 46 of the side edges 38, 40 adjacent to the bottom edge 36 of the housing wall panels 21, 22, 23, 24 are preferably formed with no flange 44 appended to them as shown best in FIGS. 1, 2 and 6.

Housing wall panels 21, 22, 23, 24 are preferably of unitary construction and are made from fiberglass reinforced plastic. In preferred embodiments, Hetron FR 992 is the fiberglassing resin used to produce housing wall panels 21, 22, 23, 24, although any suitable resin may be used. It is within the scope of the invention as presently perceived to provide housing wall panels 21, 22, 23, 24 made using any type of fiberglass. Alternatively, housing wall panels 21, 22, 23, 24 can be made from stainless steel or black iron, or if a more complex shape is desired a frame can be made from black iron provided in the desired shape and covered by plastic panels, preferably by fiberglass reinforced plastic panels.

Housing wall panels 21, 22, 23, 24 made from Hetron FR 992 resin have an insulating value that is somewhat better than steel. A fire retardant, either APE 1540 pentoxide or antimony trioxide, is added to the resin to give housing wall panels 21, 22, 23, 24 a class 1 fire rating with flame spread of 25 or less on the scale established by the ASTM E84 tunnel test. In preferred embodiments, housing wall panels 21, 22, 23, 24 have an interior colored wax coating. Preferably, the coating consists of Hetron FR 992 resin having 12% to 15% gelcoat for enhanced chemical resistance, though any suitable resin can be used.

Advantageously, the external flanges 44 provide structural rigidity to the panels 21, 22, 23, 24. The width 48 of the flange 44 can be varied to meet the structural requirements of the housing 10 for each application. Also, the thickness 50 of the housing wall panels 21, 22, 23, 24, shown best in FIGS. 3–6, is typically ⅛ inches (3.2 mm), though it can be customized to meet the structural requirements of the housing 10 for each application.

Additionally, the roof panel 26 is sloped at an angle 52, as shown best in FIG. 2, to reduce the cross-sectional area of the housing, thereby reducing heat loss in the spray stages. The slope of the roof panel 26 also aids in the run-off of droplets of solution and yet allows pipe penetrations through the roof. The illustrative roof slope angle 52 is 20 degrees, though it is within the scope of the invention as presently perceived to vary the slope angle 52 between 0 degrees and 60 degrees.

As previously discussed, the housing wall panels 21, 22, 23, 24 are preferably produced with a coating on an outer surface 51. The coating may be removed from all or from a portion of roof panel 26, bottom panel 28, or the shoulder panel 30 to provide a transparent window 53. The illustrative embodiment in FIG. 1 shows the window 53 in the roof panel 26. Advantageously, a light (not shown) can be placed above the window 53 to provide additional lighting for purposes such as facilitating maintenance of the washer 12 or for providing an additional indication of exit areas.

The flanges 44 adjacent to the top edges 34 of the housing wall panels 21, 22, 23, 24 are arranged to engage the mounting bar 18 of the conveyor rail 14. Typically, a gasket 55 is disposed between each housing wall panel 21, 22, 23, 24 and the mounting bar 18 as shown in FIG. 3. A clamp assembly 54 including threaded fasteners 56 and an elongated clamp bar 58 formed to include a plurality of clamp holes 60 engages the flange 44 adjacent to the top edges 34 of the housing wall panels 21, 22, 23, 24. The clamp holes 60 are arranged to align with the mounting holes 20 of the conveyor rail 14, as illustrated in FIGS. 1 and 3, and the threaded fasteners 56 penetrate the clamp holes 60 and the mounting holes 20 and are received by threaded nuts 62 to fix the clamp bar 58 to the conveyor rail 14. Though only one threaded fastener 56 is illustrated in FIG. 1, it is preferred that each clamp hole 60 and mounting hole 20 carry a threaded fastener 56.

Illustratively, each clamp bar 58 is provided with an elongated bend to provide each clamp bar 58 with an angled profile as shown best in FIGS. 3 and 4. Each clamp bar 58 includes an elongated frame-engaging portion 64 and an elongated flange-engaging portion 67 below the frame-engaging portion 64 as shown best in FIGS. 3 and 4. The clamp holes 60 are positioned along a horizontal line below the frame-engaging portion 64. When a first side 68 of the flange 44 adjacent to the top edge 34 of each panel 21, 22, 23, 24 engages mounting bar 18 of the conveyor rail 14 and a second side 70 of the flange 44 is engaged by flange-engaging portion 67 of the clamp bar 58 as shown, for example, in FIG. 3, the threaded fasteners 56 fix the clamp bar 58 to the conveyor rail 14. The pressing force of the flange-engaging portion 67 against the flange 44 that is sandwiched between the mounting bar 18 and the flange-engaging portion 67 fixes the housing wall panel 21, 23 relative to both the clamp bar 58 and the conveyor rail 14, as shown in FIGS. 3 and 4.

Advantageously, housing 10 of the present invention can accommodate both building-supported conveyor rails 14 and floor-supported conveyor rails 14. Additionally, the housing 10 can be configured as a first embodiment having the conveyor rail 14 inside of the washer 12, as shown in FIGS. 1–3, and as a second embodiment having the conveyor rail 14 outside of the washer 12, as shown in FIG. 4.

In the first embodiment, illustrated in FIGS. 1–3, the flange 44 adjacent to the top edge 34 of each left-handed housing wall panel 21, 22 opposes the flange 44 adjacent to the top edge 34 of a right-handed housing wall panel 23, 24. The threaded fasteners 56 are arranged to penetrate the clamp bar 58 in engagement with the left-handed housing wall panel 21, the mounting bar 18, and the clamp bar 58 in engagement with the right-handed housing wall panel 23. Threaded nuts 62 fix the threaded fasteners 56 in place. In this embodiment, then, the clamp assembly 54 includes threaded fasteners 56, threaded nuts 62, and two clamp bars 58 that engage flanges 44 to clamp both flanges 44 against the mounting bar 18 of the conveyor rail 14.

In the second embodiment of the housing 10, the flanges 44 appended to the top edges 34 of the housing wall panels 21, 22, 23, 24 are typically not fixed to the conveyor rail 14. The conveyor rail 14 of the second embodiment is typically formed to include only the roller track 16 as shown in FIG. 4. The mounting bar 18 provided in the first embodiment is typically not included in the second embodiment. Instead, two hanging frame members 134 that can be either building-supported or floor-supported having elongated mounting bars 136 are provided. An elongated rub bar 138 is appended to each mounting bar 136. Each mounting bar 136 is formed to include a plurality of mounting holes 140 that are spaced apart along the entire length of the mounting bar 136 and that are arranged to penetrate the rub bar 138.

The flanges 44 adjacent to the top edges 34 of the housing wall panels 21, 22, 23, 24 are arranged to engage the mounting bar 136, as shown in FIG. 4. Typically, a gasket (not shown) is disposed between each housing wall panel 21, 22, 23, 24 and the mounting bar 136. The clamp assembly 54, including threaded fasteners 56 and the elongated clamp bar 58 which is formed to include a plurality of clamp holes 60, engages the flange 44 adjacent to the top edges 34 of the housing wall panels 21, 22, 23, 24. The clamp holes 60 are arranged to align with the mounting holes 140 of the mounting bar 136, as illustrated in FIG. 4, and the threaded fasteners 56 penetrate the clamp holes 60 and the mounting holes 140 and are received by threaded nuts 62 to fix the clamp bar 58 to the mounting bar 136.

A housing 10 in accordance with the present invention can be assembled with as few as two housing wall panels 21, 23. In this configuration, the left-handed housing wall panel 21 opposes the right-handed housing wall panel 23 so that the flange 44 appended to the top edge 34 of housing wall panel 21 is adjacent to the flange 44 appended to the top edge 34 of housing wall panel 23. The housing 10 can also be assembled using as many additional housing wall panels 21, 22, 23, 24 as are necessary to provide sufficient length 25 along the conveyor rail 14 to accommodate a user'specific washing process. Illustratively, the housing 10 can be provided with four housing wall panels 21, 23, 22, 24, having two side-by-side housing wall panels 21, 22 opposing two other side-by-side housing wall panels 23, 24 as shown in FIG. 1.

First and second housing wall panels 21, 23 are in side-by-side relation with third and fourth housing wall panels 22, 24. The third and fourth housing wall panels 22, 24 are arranged to abut the first and second housing wall panels 21, 23. As discussed above, each housing wall panel 21, 22, 23, 24 is formed to include a first side edge 38 and a second side edge 40. The flange 44 on each housing wall panel 21, 22, 23, 24 is appended to the side edges 38, 40. The flange 44 adjacent to the second side edge 40 of housing wall panels 21, 23 engages the flange 44 adjacent to first side edge 38 of housing wall panels 22, 24.

Figure 5:
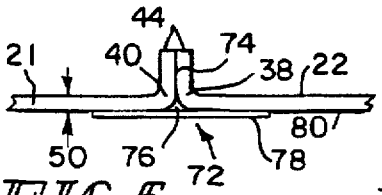
FIG. 5 is a plan view of a joint between two housing wall panels showing the edges of the housing wall panels with outwardly extending flanges, a fillet on the interior of the joint opposite the flanges, and a covering material covering the fillet.

Once housing wall panels 21, 22, 23, 24 are appended to conveyor rail 14 and flanges 44 adjacent to side edges 38, 40 are in engagement, the abutting flanges 44 are joined. In the preferred embodiment, a gap 72 at the joint 74 is filled with a fillet 76 and then covered by a covering material 78, as shown in FIG. 5. In preferred embodiments housing wall panels 21, 22, 23, 24 are made from fiberglass reinforced plastic so that the joining of the flanges 44 includes roughening the engaging surfaces of the flanges 44 and bonding the flanges 44 with a fiberglassing resin. The fillet 76 is typically a mill-fiber putty and the covering material 78 is typically additional fiberglassing resin and fiberglass mat, typically applied in one or two layers depending upon the thickness required as dictated by the size of housing wall panels 21, 22, 23, 24. This type of joining will hereinafter be referred to as the "glassing" together of the pieces being joined. In this instance, the abutting flanges 44 are glassed together.

Although the preferred joining structure of housing wall panels 21, 22, 23, 24 is produced by glassing together flanges 44, it is within the scope of the invention as presently perceived to join abutting flanges 44 by any suitable joining technique including bolting flanges 44 together, riveting flanges 44 together, gluing flanges 44 together, and clamping flanges 44 together.

The structure at the joint 74 when flanges 44 are glassed together provides for a smooth and continuous interior surface 80 along the entire length 25 of the housing 10. Advantageously, it is much easier to clean a housing 10 having a smooth interior surface 80. Additionally, glassing together flanges 44 provides a water-tight seal between flanges 44 and allows internal components (not shown) such as pipe supports, stiffeners, and other components, to be easily located and assembled inside of the housing 10. The internal components can be glassed to the interior surface 80 of the housing 10 in a manner similar to the bonding of the flanges 44, thereby providing weld-like connections.

Silhouette panels 82 and end panels 83 can also be glassed or bolted to the interior surface 80 of the housing 10. Silhouette panels 82 are positioned to lie in orthogonal relation to the interior surface 80 as illustrated in FIGS. 1–3, and are useful for separating the washer 12 into separate chambers, separating the washer 12 from adjacent in-line industrial finishing processes, as well as stiffening the housing wall panels 21, 22, 23, 24, supporting pipe headers 84 as shown in FIGS. 2 and 3, and supporting a conveyor guard 86 as shown in FIGS. 2 and 3. End panels 83 can be provided adjacent to ends of housing 10 and are useful for enclosing washer 12, stiffening housing wall panels 21, 22, 23, 24, supporting pipe headers 84, and supporting conveyor guard 86.

Advantageously, the smooth and continuous interior surface 80 of the housing 10 allows for infinite placement of the silhouette panels 82 along the interior surface 80, thereby providing significant flexibility in the design of the washing process. Typically, silhouette panels 82 and end panels 83 are made from the same materials as housing wall panels 21, 22, 23, 24, although fiberglass reinforced plastic silhouette panels 82 are typically not provided with a gelcoat coating and end panels 83 are typically provided with gelcoat only on the exterior of end panels 83. As with the internal components, the silhouette panels 82 and end panels 83 can be glassed to the interior surface 80 in a manner similar to the joining of the flanges 44 described above.

Satisfactory results can also be achieved by appending silhouette panels 82 and end panels 83 to interior surface 82 using techniques other than glassing silhouette panels 82 and end panels 83 in place. For example, clip angles 85 can be glassed to interior surface 80 and silhouette panels 82 and end panels 83 can be bolted, riveted, or even clamped to clip angles 85 as shown, for example, in FIGS. 2 and 3. It is within the scope of the invention as presently perceived to append silhouette panel 82 and end panels 83 to interior surface 82 using any technique that provides an acceptable connection.

The conveyor guard 86 includes two elongated guard pieces 88 that are mounted to silhouette panels 82 as shown, for example, in FIGS. 2 and 3. The guard pieces 88 are mounted to silhouette panels 82 using clip angles 91 that can be bolted or glassed to silhouette panels 82 and that receive threaded fasteners 89 that pass through openings in clip angles 91 and are received by threaded nuts 93. With this attachment structure, shown in FIGS. 2 and 3, guard pieces 88 are removable. Although it is preferred that the guard pieces 88 are bolted to clip angles 91, guard pieces 88 can alternatively be bolted to clip angles appended to housing wall panels 21, 22, 23, 24, or guard pieces 88 can be glassed directly to either housing wall panels 21, 22, 23, 24, silhouette panels 82, or end panels 83.

The elongated guard pieces 88 include proximal ends 90 and distal ends 92 that are spaced-apart to define an elongated feed-through or passageway 94 therebetween, as shown best in FIGS. 2 and 3. A roller assembly 98 movably engages the roller track 16. A work piece 96 is carried on a hanger 97 appended to the roller assembly 98. The hanger 97 moves through passageway 94 as the roller assembly 98 moves along the roller track 16 and the work piece 96 passes through the housing 10.

Conveyor guard 86 is provided in spray zones of the washer 12 to impede the direct impingement of washing solution 99 onto the conveyor rail 14 and the roller assembly 98 as shown in FIG. 2. The conveyor guard 86 is typically made from fiberglass reinforced plastic, though any suitable material including black iron, stainless steel, PVC, or any other material apparent to one skilled in the art may be used.

The second embodiment of this invention, shown in FIG. 4, does not typically include the conveyor guard 86. The mounting bars 136 are spaced apart and are arranged so that an elongated feed-through or passageway 142 is defined by the rub bars 138. The roller assembly 98 movably engages the roller track 16. The work piece 96 is carried on hanger 97 appended to the roller assembly 98. The hanger 97 moves through passageway 142 as the roller assembly 98 moves along the roller track 16 and the work piece 96 passes through the housing 10. In this embodiment, the conveyor rail 14 is positioned to lie outside of the housing 10 so that roof panels 26 of the housing wall panels 21, 22, 23, 24 impede the direct impingement of washing solution 99 onto the conveyor rail 14 and the roller assembly 98, as shown in FIG. 4.

A drain board panel 100 is positioned to lie underneath housing wall panels 21, 22, 23, 24 and generally centered below conveyor rail 14, as shown in FIG. 1. Drain board panel 100 includes an upwardly facing wall 102 having an inner edge 104 arranged to define a solution-return opening 106. The wall 102 of the drain board panel 100 is formed to include an elongated interior trough 108 and trough 108 can be formed to include a central support 109 having a supplemental grate-seating surface 111 as shown in FIGS. 1 and 2. Central support 109 is provided on large drain board panels 100 to provide additional support for grating sections 132 that are received thereon as described below.

The solution-return opening 106 is positioned to lie in the trough 108. The wall 102 is formed to further include two elongated grate-seating surfaces 110 positioned to lie along outer sides of the trough 108, and two elongated draining surfaces 112 positioned to lie along outer sides of the grate-seating surfaces 110, as shown in FIGS. 1 and 2. A flange 114 is appended to the outer edge 116 of each draining surface 112.

Figure 6:
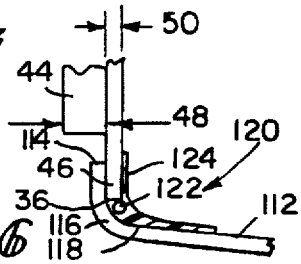
FIG. 6 is a side elevation view of a joint between a foot of a housing wall panel and the drain board panel showing a fillet between the drain board panel and the foot of the housing wall panel and a covering material covering the fillet.
Figure 7:
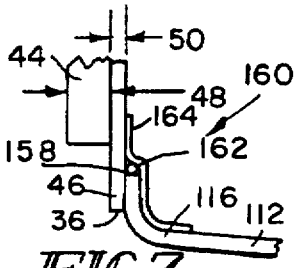
FIG. 7 is a view similar to FIG. 6 showing the foot positioned to lie outside of the drain board panel and the joint having a fillet between the drain board panel and the foot of the housing wall panel and a covering material covering the fillet.

The drain board panel 100 is arranged so that the drain board-receiving portions 46 along the bottom edges 36 of housing wall panels 21, 22, 23, 24 engage the flanges 114 and the drain board panel 100 adjacent to the outer edges 116, as illustrated in FIGS. 2, 6, and 7. Housing wall panels 21, 22, 23, 24 can be positioned to lie inside of drain board panel 100 as shown in FIG. 6. The drain board-receiving portions 46 are then appended to the flanges 114 and a gap 118 at the joint 120 is filled with a fillet 122 and covered by a covering material 124 as shown in FIG. 6.

Alternatively, housing wall panels 21, 22, 23, 24 can be positioned to lie outside of drain board panel 100 as shown in FIG. 7. The drain board-receiving portions 46 are then appended to the flanges 114 and a gap 158 at the joint 160 is filled with a fillet 162 and covered by a covering material 164 as shown in FIG. 7.

Drain board panels 100 are preferably made from fiberglass reinforced plastic. As with the joints 74 between the flanges 44, the flanges 114 and the drain board-receiving portions 46 can be glassed together by roughening the engaging surfaces of the flanges 114 and the drain board-receiving portions 46, and bonding the flanges 114 and the drain board-receiving portions 46 with a fiberglassing resin. The fillet 122, 162 is typically a mill-fiber putty and the covering material 124, 164 is typically additional fiberglassing resin and fiberglass mat, typically applied in one or two layers depending upon the thickness required as dictated by the size of housing wall panels 21, 22, 23, 24. This joining structure forms a water-tight seal between the drain board panel 100 and the housing wall panels 21, 22, 23, 24. However, it is within the scope of the invention as presently perceived to instead provide gasketed or water seal joints in place of joints 120, 160 described above.

Drain board panels 100 form the floor of the housing 10. The materials of construction of the drain board panels 100 are typically identical to those of the housing wall panels 21, 22, 23, 24 except that typically no gelcoat is applied to the drain board panels 100. In addition, draining surfaces 112 of drain board panels 100 can be formed to include non-skid surfaces, for example by placing sand (not shown) on draining surfaces 112 during fabrication before applying the final resin coat so as to provide a roughened surface having the sand incorporated into the draining surface 112.

In preferred embodiments, the shape of the drain board panels 100 is arranged to direct run-off sprayed solution 99 to the center trough 108. The solution 99 flows through the opening 106 to a tank 126 positioned to lie beneath the opening 106. However, the drain board panels 100 can be either flat or sloped. Also, dams 128 can be installed in the trough 108 beneath the grating 132 to divide trough 108 of drain board panel 100 into stages, as shown in FIG. 1.

The drain board panel 100 is designed to support grating sections 132, which are sized to be received on the grate-seating surfaces 110, 111 of the drain board panel 100 as shown in FIG. 2. Central support 109 can optionally be included on drain board panel 100 to provide additional structural rigidity to drain board panel 100 and to provide additional support for grating sections 132. Grating sections 132 can be provided over the entire length 25 of the washer 12, in certain sections of the washer 12, or they can be omitted completely.

The drain board panel 100 typically rests on a tank 126 for support as shown in FIG. 2. Tank 126 includes an upper lip 127 that may be appended to a steel frame (not shown). In the alternative, lip 127 may be integrated into the steel frame to constitute a portion of the steel frame. In both configurations, the drain board panel 100 only rests on the lip 127 and is not connected to the lip 127, thereby permitting differential expansion between lip 127, and the drain board panel 100 and the housing wall panels 21, 22, 23, 24 that are appended to the drain board panel 100. Generally, the steel frame houses the tank 126 containing washing solution 99. Hollow pipes 144 having a plurality of spray nozzles 146 appended to the pipes 144 are in fluid communication with the tank. A pump 145 is provided to supply pressurized solution to the interior of the pipes 144 as shown in FIG. 2.

The roller assembly 98 is configured to continuously move the work piece 96 along the roller track 16 of the conveyor rail 14 through the industrial finishing equipment. The pipes 144 are positioned to lie adjacent to the perimeter of the washer 12 and the spray nozzles 146 are spaced apart and are aimed toward the interior of the washer 12, as shown in FIG. 2, so that the work piece 96 is drenched by the solution 99 as the roller assembly 98, from which the work piece 96 is hanging, passes through the washer 12.

The openings 106 in the drain board panels 100 are arranged to receive sprayed solution 99 that runs off of the work piece 96, the housing wall panels 21, 22, 23, 24, the silhouette panels 82, the end panels 83, and other surfaces positioned inside of the housing 10. The solution 99 can be permitted to run into the tank positioned underneath the opening 106 to be recycled for later use. The grating sections 132 are positioned over the openings 106 to prevent foreign material from entering the openings 106. The grating sections 132 also provide a walking surface for maintenance workers working inside of the housing 10.

As previously mentioned, the silhouette panels 82 may be configured to support pipe headers 84 appended to the pipes 144. Pipe headers 84 may be positioned above work piece 96 as shown in FIG. 2 or below work piece 96 as shown in FIG. 3. Additionally, pipe headers 84 may penetrate roof panel 26, shoulder 30, or bottom panel 28 of housing wall panels 21, 22, 23, 24 in which case the pipe header 84 is provided with a gasketed seal (not shown) to prevent leakage through housing wall panel 21, 22, 23, 24.

Typically, the pipe header 84 penetrates an opening 148 sized to receive the pipe header 84 that is formed in the silhouette panel 82 as shown in FIGS. 2 and 3. A platform 150 is positioned to lie adjacent to the opening 148 and is appended to the silhouette panel 82. Threaded fasteners 152 can be used to mount the platform 150 to the silhouette panel 82, or the platform can be glassed to the silhouette panel having a joint structure similar to the joint 74 between the flanges 44 described above. A band 154 is pulled around the pipe 144 and is bolted to the platform 150 to fix the pipe 144 to the platform 150.

Advantageously, the fiberglass reinforced plastic housing 10 can be used in combination with industry standard stainless steel or black iron components (not shown) such as tanks, exhaust systems, and access ladders. Also, the washer 12 in accordance with the present invention can be used as a pre-finishing treatment station and can be modified for use as a post-finishing rinse station having multiple stages to remove the cream coat after electrodeposited paint application. Modifications for this use might include employing alternate fastening techniques and altering the slope of the draining surfaces 112 of the drain board panels 100.

Construction from fiberglass reinforced plastic provides improved resistance to corrosion at a cost that is less than the cost of stainless fiberglass use of fiberglass reinforced plastic also provides exceptional flexibility with respect to the sizes and shapes of the assorted component parts. The flanges 44, 114 stiffen housing wall panels 21, 22, 23, 24 thereby allowing for the washer 12 to be built with no internal support frame, which would typically be made from steel. Advantageously, eliminating the internal support frame eliminates problems caused by the difference between the coefficients of thermal expansion of plastics and metals.

Figure 8:
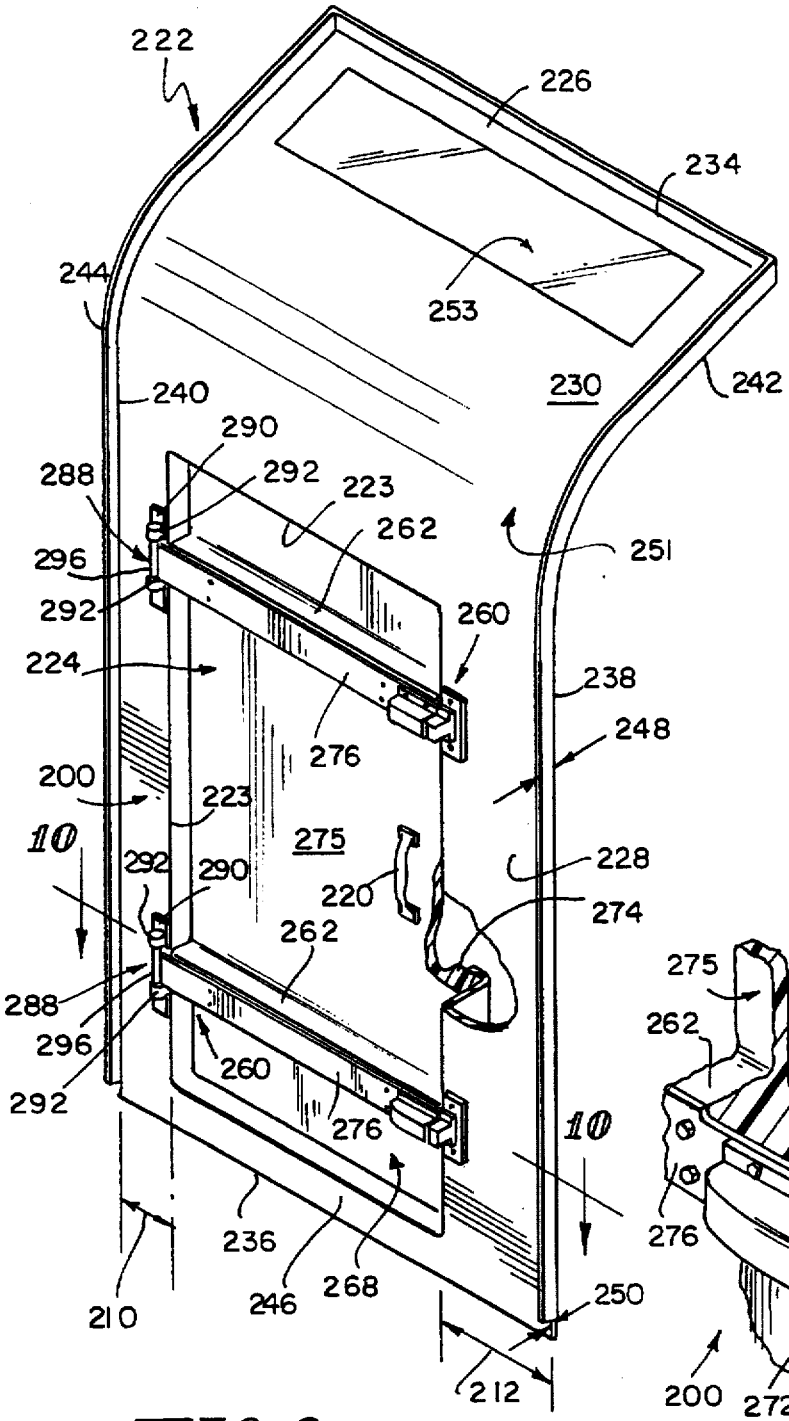
FIG. 8 is a perspective view of a housing wall panel showing an opening sized to receive a fiberglass door formed in the housing wall panel and a fiberglass door received in the opening.
Figure 9:
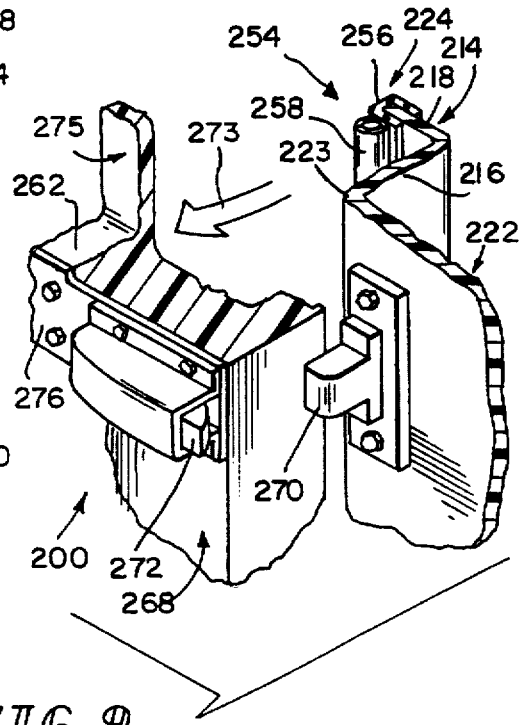
FIG. 9 is an enlarged sectional view of a portion of the housing wall panel and fiberglass door of FIG. 8 showing a latching mechanism and a door seal interposed between the fiberglass door and the fiberglass frame.
Figure 10:
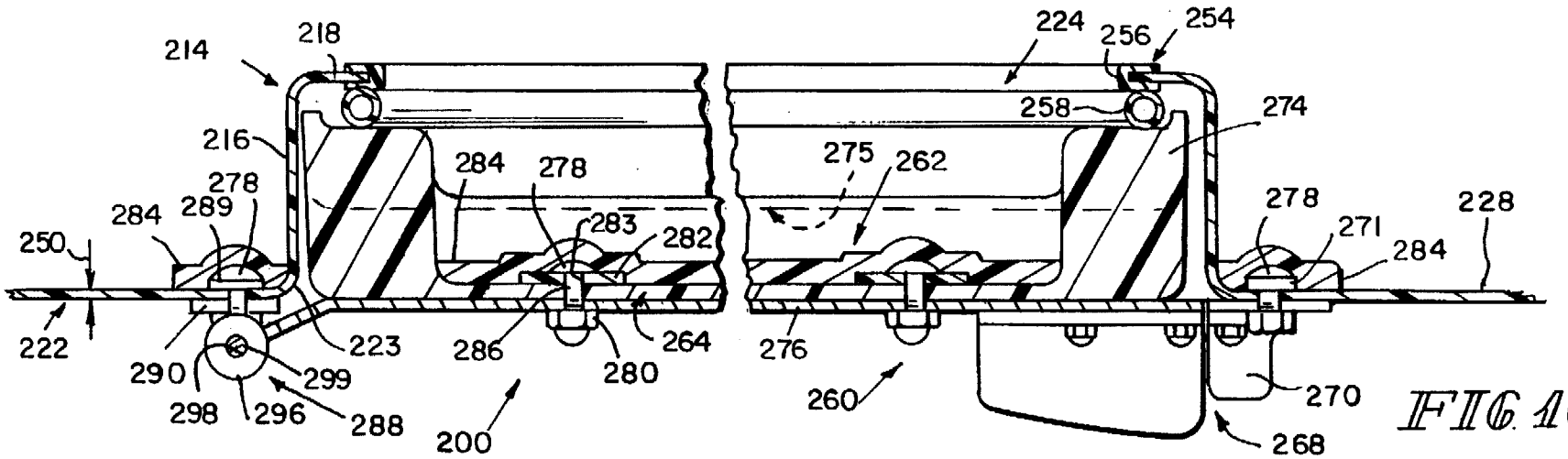
FIG. 10 is a view taken along line 10—10 of FIG. 8 showing the housing wall panel having a recessed frame that is integral with the housing wall panel, the fiberglass door positioned to lie in a recess formed by the housing wall panel and the frame so that portions of the front of the fiberglass door are flush with the front of the housing wall panel, a cylindrical hinge mounted to the left side of the fiberglass door, and the latching mechanism mounted to the right side of the door cooperating with a latch-receiving portion mounted to the frame adjacent to the right side of the door.

Additionally, housing wall panels 21, 22, 23, 24 can be configured to receive a fiberglass door 200 made from fiberglass reinforced plastic to provide workers with ingress into and egress out of the washer 12. Illustratively, FIGS. 8–10 show a housing wall panel 222 formed to include a door-receiving opening 224 that is sized to receive fiberglass door 200. Housing wall panel 222 is substantially similar to housing wall panels 21, 22, 23, 24 as described below. Housing wall panel 222 includes a roof panel 226, a bottom panel 228, and a shoulder 230 interconnecting the roof panel 226 and the bottom panel 228.

The roof panel 226 is arranged to have a slope similar to angle 52 shown for roof panel 26 of housing wall panel 21 in FIG. 2, so that the roof panel 226 is positioned to lie at an angle 52 other than a right angle to the bottom panel 228. Shoulder 230 is produced with a curvature of a predetermined radius similar to radius 32 of shoulder 30 in housing wall panel 21 as shown in FIG. 2.

Housing wall panel 222 is formed to include a top edge 234, a bottom edge 236 positioned to lie in spaced-apart relation to the top edge 234, a first side edge 238, and a second side edge 240 positioned to lie in parallel spaced-apart relation to the first side edge 238 as shown in FIG. 8. The top edge 234, bottom edge 236, first side edge 238, and second side edge 240 cooperate to define a perimetral edge 242.

An outwardly-extending flange 244 is appended to the perimetral edge 242 as shown in FIG. 8. Though the flange 244 can be formed to encircle the entire perimetral edge 242 of each housing wall panel 222, satisfactory results have been achieved by appending the flange 244 to only the top edge 234 and both side edges 238, 240 as shown in FIG. 8. The bottom edge 236 and a drain board-receiving portion 246 adjacent to the bottom edge 236 of the housing wall panel 222 are preferably formed with no flange 244 appended to them as shown in FIG. 8.

Housing wall panel 222 is preferably of unitary construction and is made from fiberglass reinforced plastic. In preferred embodiments, Hetron FR 992 is the fiberglassing resin used to produce housing wall panel 222, though any suitable resin may be used. It is within the scope of the invention as presently perceived to provide housing wall panel 222 made from any type of fiberglass reinforced plastic. Alternatively, housing wall panel 222 can be made from stainless steel or black iron, or if a more complex shape is desired a frame can be made from black iron provided in the desired shape and covered by plastic panels, preferably by fiberglass reinforced plastic panels.

Housing wall panel 222 made from Hetron FR 992 resin has an insulating value that is somewhat better than steel. A fire retardant, either APE 1540 pentoxide or antimony trioxide, is added to the resin to give housing wall panel 222 a class 1 fire rating with flame spread of 25 or less on the scale established by the ASTM E84 tunnel test. In preferred embodiments, housing wall panel 222 has an interior colored wax coating. Preferably, the coating consists of Hetron FR 992 resin having 12% to 15% gelcoat for enhanced chemical resistance, though any suitable resin can be used.

Advantageously, the external flanges 244 provide structural rigidity to the panel 222. The width 248 of the flange 244 can be varied to meet the structural requirements of the housing 10 for each washer 12 application. Also, the thickness 250 of the housing wall panel 222 is typically ⅛ inches (3.2 mm), though it can be customized to meet the structural requirements of the housing 10 for each washer 12 application.

Housing wall panel 222 is preferably produced with a coating on an outer surface 251. Preferably, the coating is removed from all or from a portion of roof panel 226 to provide a transparent window 253 as shown in FIG. 8.

Advantageously, a light (not shown) can be placed above the window 253 to provide additional lighting for purposes such as facilitating maintenance of the washer 12 or for providing an additional indication of exit areas.

Housing wall panel 222 is formed to include an inner edge 223 that defines a door-receiving opening 224 as shown in FIG. 8. Door-receiving opening 224 is typically formed in bottom panel 228 above drain board-receiving portion 246 and is positioned to lie between first side edge 238 and second side edge 240. A distance 210 between first side edge 238 and inner edge 223 and a distance 212 between second side edge 240 and inner edge 223 can be varied to adjust the position of door-receiving opening 224 relative to the first and second side edges 238, 240, to suit the specific needs of a washer 12 upon which housing wall panel 222 having fiberglass door 200 is being installed.

A door frame 214 is integrally appended to inner edge 223 of housing wall panel 222 as shown in FIGS. 9 and 10 adjacent to door-receiving opening 224 and is arranged to encircle the entire door-receiving opening 224. Door frame 214 includes a support portion 216 extending inwardly toward the inside of washer 12 appended to inner edge 223 and a seal portion 218 appended to support portion 216 and extending in a direction perpendicular to support portion 216 and away from the perimetral edge 242 of housing wall panel 222 toward the center of door-receiving opening 224.

An annular seal 254 including a door frame-engaging portion 256 and a door-sealing portion 258 is mounted on seal portion 218 as shown in FIGS. 9 and 10. Door frame-engaging portion 256 fits around seal portion 218 of door frame 214 to mount seal 254 to door frame 214 as shown in FIGS. 9 and 10. Seal 254 is arranged so that door-sealing portion 258 engages fiberglass door 200 when fiberglass door 200 is in a closed position as shown in FIGS. 8 and 9 to prevent the flow of washing solution 99 through door-receiving opening 224.

Fiberglass door 200 includes a perimetral support flange 274 as shown in FIGS. 8–10. Perimetral support flange 274 is a thickened structure that frames the fiberglass door 200 to provide additional strength to the fiberglass door 200. Perimetral support flange 274 can include wood or some other filler material (not shown) surrounded by fiberglass reinforced plastic to enclose the filler material within the fiberglass reinforced plastic. Perimetral support flange 274 engages door-sealing portion 258 of seal 254 when fiberglass door 200 is in the closed position, as shown in FIG. 10, and door panels 275 are positioned to lie within the area defined by perimetral support flanges 274.

A handle 220 is connected to door panels 275 of fiberglass door 200 as shown in FIG. 8. Fiberglass door 200 includes two transverse raised portions 262 appended to door panels 275. Each raised portion 262 receives a door-mounting assembly 260. Raised portions 262 are configured so that top surfaces 264 of raised portions 262 are flush with a front surface 266 of housing wall panel 222, as shown in FIGS. 8 and 10. Each door-mounting assembly 260 includes a latch mechanism 268, shown best in FIG. 9, for retaining the fiberglass door 200 in the closed position.

Latch mechanism 268 is configured to retain the fiberglass door 200 in the closed position and to allow fiberglass door 200 to move outwardly away from the closed position when sufficient force is applied to fiberglass door 200 to disengage latch mechanism 268. Illustratively, latch mechanism 268, shown best in FIG. 9, includes a post-type striker (not shown) in striker housing 270 and a spring-loaded latch 272 that engages the striker to retain the fiberglass door 200 in the closed position. Illustrative latch mechanism 268 is configured so that latch 272 disengages from the striker to allow fiberglass door 200 to move away from the closed position when sufficient outwardly directed force, designated by double arrow 273 in FIG. 9, is applied to the fiberglass door 200.

Each door-mounting assembly 260 further includes a strap 276 that engages raised portion 262 as shown best in FIGS. 8 and 10. Strap 276 is mounted to raised portion 262 by threaded bolts 278 that engage threaded nuts 280 as shown in FIG. 10. A strap back-up plate 282 provided with an opening 283 having a square portion is positioned to lie between each bolt 278 and fiberglass door 200, and an additional layer 284 of fiberglass reinforced plastic is applied to the rear of fiberglass door 200 adjacent to raised portion 262 to cover bolts 278 and to seal undesired openings that may be present in door-mounting assembly 260 adjacent to bolts 278.

Additional fiberglass layer 284 prevents washing solution 99 from leaking through any undesired openings present in door-mounting assembly 260 adjacent to bolts 278 and eliminates exposure of bolts 278 to washing solution 99, thereby avoiding corrosion of bolts 278 due to exposure of bolts 278 to washing solution 99. Advantageously, bolts 278 are provided with stems having square portions 286 that engage flat portions of openings 283 of strap back-up plates 282 so that bolts 278 are not rotatable relative to back-up plates 282. Back-up plates 282 are fixed to fiberglass door 200, and as a result bolts 278 are not rotatable relative to fiberglass door 200. This allows nuts 280 to be attached and removed from bolts 278 as desired after fiberglass layer 284 is applied to bolts 278 so that straps 276 can be removed and replaced if desired.

Likewise, striker housing 270 and hinges 288 are bolted to fiberglass door 200 using bolts 278 having square portions 286 that mate with square portions formed in openings 232 in back-up plates 271, 289 attached to housing wall panel 222 to prevent rotation of bolts 278 therein. The additional fiberglass layer 284 is applied to the interior of washer 12 adjacent to striker housing 270 and hinges 288 so that bolts 278 are coated with fiberglass after being mounted through fiberglass door 200.

Each hinge 288 includes another plate 290 having two outwardly extending spaced apart cylindrical holders 292 attached thereto. Holders 292 are formed to include openings defining a cylindrical space (not shown) therein. Plate 290 includes two openings (not shown) arranged to receive bolts 278 for mounting hinge 288 to housing wall panel 222. Holders 292 are spaced apart a sufficient distance to receive a cylindrical strap spool 296 therebetween. Strap spool 296 is integrally appended to strap 276 and is formed to include an opening 298 that cooperates with openings in holders 292 to receive rivets 299 therethrough that hold strap spool 296 between holders 292 as shown in FIG. 10. Fiberglass door 200 is pivotably attached to housing wall panel 222 by rivets 299 that hold strap spools 296 of straps 276 between holders 292 of hinges 288 allowing strap spools 296 to rotate relative to holders 292 as fiberglass door 200 pivots between the inward closed position and an outward open position.

Fiberglass door 200 can be mounted on housing wall panel 222 to swing outwardly and to the left, as shown in FIG. 8, or outwardly and to the right, providing flexibility that allows for installation of a fiberglass door 200 that is customized for each specific washer installation site. This is made possible by raised portions 262 of fiberglass door 200 which are of uniform cross section so that door mounting assemblies 260 can be mounted with strap spools 296 on the left side of fiberglass door 200 and latch mechanisms 268 on the right, as shown in FIGS. 8–10, or with strap spools 296 on the right side of fiberglass door 200 with latch mechanism 268 on the left.

Housing wall panel 222 is assembled into washer 12 and can be joined to housing wall panels 21, 22, 23, 24 in the same manner that housing wall panels 21, 22, 23, 24 are assembled and joined. Flange 244 adjacent to the top edge 234 of the housing wall panel 222 engages the mounting bar 136. The clamp assembly 54, including threaded fasteners 56 and elongated clamp bar 58 which is formed to include a plurality of clamp holes 60, engages flange 244 adjacent to top edge 234 of the housing wall panel 222. Clamp holes 60 align with mounting holes 140 of the mounting bar 136 and threaded fasteners 56 penetrate the clamp holes 60 and mounting holes 140 and are received by threaded nuts 62 to fix clamp bar 58 to mounting bar 136.

Once housing wall panel 222 is appended to conveyor rail 14, a housing wall panel 21, 22, 23, 24 may be placed beside housing wall panel 222. Flange 244 of housing wall panel 222 adjacent to side edge 238 or 240 will engage flange 44 adjacent either to side edge 38 or 40 of housing wall panel 21, 22, 23, 24, and the abutting flanges 244, 44 can be joined using the methods described above.

Figure 11:
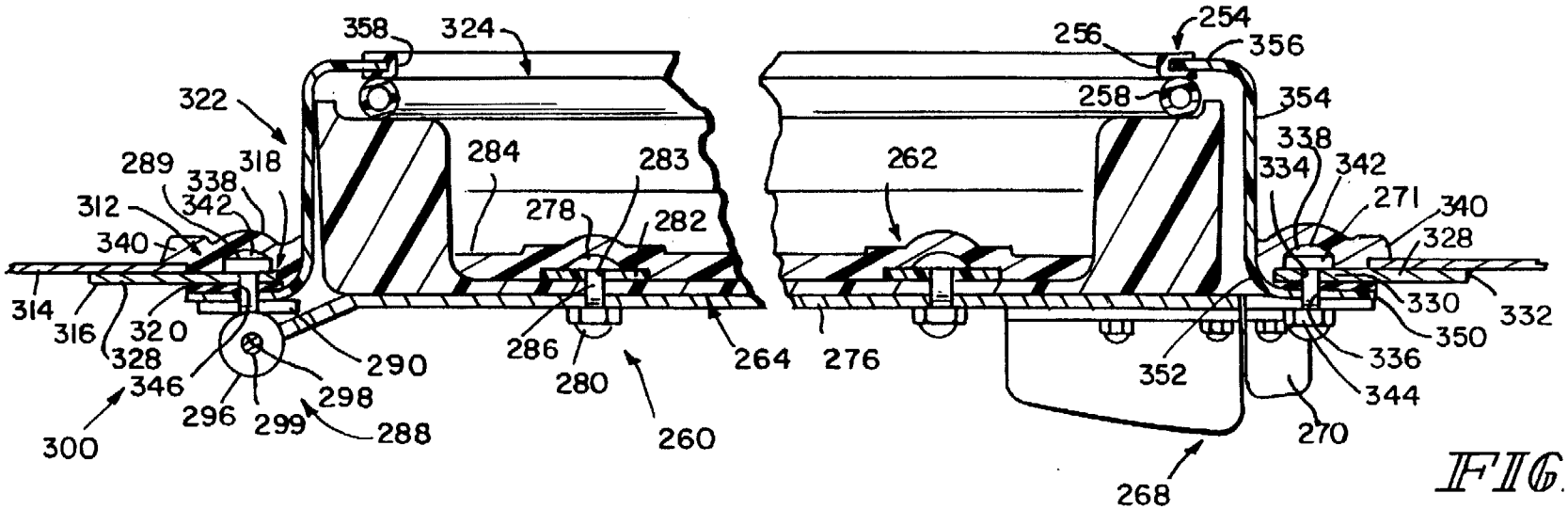
FIG. 11 is a view similar to FIG. 10 of a fiberglass door mounted to an opening formed in a non-fiberglass washer wall showing a fiberglass frame interposed between the washer wall and the fiberglass door, a steel frame interposed between the fiberglass frame and the washer wall, a hinge mounted to the left side of the fiberglass door and the fiberglass frame, and a door latching mechanism mounted to the right side of the door cooperating with a latch-receiving portion mounted to the frame adjacent to the right side of the door.

Advantageously, washers 300 without housing wall panel 222 can be retrofitted to accept fiberglass door 200, as shown in FIG. 11. Typically, washers 300 without fiberglass door 200 are made from steel. Washer 300 can be retrofit to accept fiberglass door 200 by: cutting a hole 312 into a wall 314 of washer 300, mounting a steel frame 316 having an opening 318 onto wall 314 adjacent to hole 312 and welding steel frame 316 to wall 314, placing a gasket 320 against steel frame 316, placing a door frame 322 having a door-receiving opening 324 and preferably made from fiberglass reinforced plastic around steel frame 316 so that door frame 322 surrounds opening 318 formed in steel frame 316 and traps gasket 320 between steel frame 316 and door frame 322, and bolting door frame 322 to steel frame 316, thereby forming a seal between steel frame 316 and door frame 322. Door frame 322 is configured to receive fiberglass door 200, that is configured to move between a closed position covering door-receiving opening 324 and an open position away from door-receiving opening 324.

Once door frame 322 is installed, installation of fiberglass door 200 is completed by mounting striker housings 270 to door frame 322 and steel frame 316, mounting hinges 288 to door frame 322 and steel frame 316, placing fiberglass door 200 into door frame 322 so that strap spools 296 are received between holders 292 of hinges 288, and inserting rivets 299 into hinges 288 and strap spools 296 so that hinges 288 and rivets 299 cooperate with strap spools 296 to mount fiberglass door 200 to door frame 322.

Steel frame 316 is a unitary stamped stainless steel sheet that is generally rectangular and that includes opening 318 so that steel frame 316 includes a top (not shown), a bottom (not shown), and two sides 328. Steel frame 316 further includes an inner frame portion 330 and an outer frame portion 332. Outer frame portion 332 engages and is welded to wall 314 of washer 300 adjacent to hole 312 that is cut into wall 314. The weld is completed in a manner to provide a watertight joint between wall 314 and outer frame portion 332 adjacent to all four of the top (not shown), the bottom (not shown), and sides 328.

Inner frame portion 330 is provided with a plurality of spaced-apart openings 334 that are sized to receive bolts 336 as shown in FIG. 11. Openings 334 are provided on all four of the top (not shown), the bottom (not shown), and sides 328 of inner frame portion 330 of steel frame 316. Corresponding openings 336, 346 are formed in door frame 322 and gasket 320 respectively, and bolts 338 are received by openings 334, 336, and 346.

An additional fiberglass layer 340 is applied to steel frame 316 adjacent to the inside of washer 300 covering heads 342 of bolts 338 as shown in FIG. 11. Additional fiberglass layer 340 prevents washing solution 99 from leaking through any undesired openings present in steel frame 316 adjacent to bolts 338 and eliminates exposure of bolts 338 to washing solution 99, thereby avoiding corrosion of bolts 278 due to exposure of bolts 278 to washing solution 99.

Gasket 320 is applied to inner frame portion 330 of steel frame 316 and is positioned to lie between steel frame 316 and door frame 322. Openings 334, 336, and 346 formed in steel frame 316, door frame 322, and gasket 320 receive bolts 338 that mount door frame 322 and gasket 320 to steel frame 316. Openings 334, 336, and 346 are spaced apart along inner frame portion 330 as required to provide sufficient sealing force between door frame 322 and steel frame 316 to trap gasket 320 therebetween to provide a watertight seal around the circumference of inner frame portion 330 of steel frame 316.

Fiberglass reinforced plastic door frame 322 includes a planar gasket-engaging portion 350 adjacent to inner frame portion 330 of steel frame 316, as shown in FIG. 11. Gasket-engaging portion 350 includes an inner edge 352. A support portion 354 of door frame 322 is integrally appended to edge 352 of gasket-engaging portion 350 and extends inwardly into washer 300 therefrom. A seal portion 356 is integrally appended to support portion 356 and extends in a direction perpendicular to support portion 354 toward the center of door frame 322 and away from gasket-engaging portion 350 of door frame 322. Seal portion 356 includes an inner edge 358 that defines door-receiving opening 324, and door frame-engaging portion 256 of seal 254 fits around inner edge 358 of seal portion 356 of door frame 322 to mount seal 254 to door frame 322.

Door frame 322 is configured to be substantially similar to door frame 214 that is integrally appended to housing wall panel 222 discussed above. Installation of fiberglass door 200 onto door frame 322 is substantially similar to installation of fiberglass door 200 onto door frame 214.

As described above, fiberglass door 200 includes raised portions 262 having top surfaces 264 onto which door-mounting assemblies 260 are mounted. Plates 290 of hinges 288 are mounted to door frame 322, gasket 320, and steel frame 316 using bolts 338 that are received by openings 294 in plate 290 and openings 334, 336, and 346 in steel frame 316, door frame 322, and gasket 320, described above. Likewise, striker housing 270 is mounted to steel frame 316, door frame 322, and gasket 320.

Advantageously, as with housing wall panel 222, fiberglass door 200 can be mounted to swing outwardly and to the left or outwardly and to the right, providing flexibility that allows for retrofitting fiberglass door 200 to many installed washers 300. Raised portions 262 of fiberglass door 200 are of uniform cross section so that door mounting assemblies 260 can be mounted with strap spool 296 on the left side of fiberglass door 200 and latch mechanism 268 on the right, as shown in FIG. 11, or with strap spool 296 on the right side of fiberglass door 200 with latch mechanism 268 on the left.

Typically, when fiberglass door 200 is installed on washer 300, it is installed as a replacement for an original door that was provided by the original equipment manufacturer. To install fiberglass door 200, workers cut the original door and the original door frame out of washer 300, leaving hole 312 in wall 314 of washer 300 where the original door had been located.

Steel frame 316 is sized so that outer frame portion 332 engages wall 314 adjacent to hole 312 with sufficient overlap between outer frame portion 332 and wall 314 so that outer frame portion 332 can be welded to wall 314 to provide a watertight joint therebetween. Inner frame portion 330 is sized to engage gasket 320 and gasket-engaging portion 350 of door frame 320. Sealing surface 360 of inner frame portion 330 engages gasket 320 and is sized to cooperate with gasket 320 and steel frame 316 to provide a watertight seal between steel frame 316 and door frame 322.

Steel frame 316 is placed against wall 314 adjacent to hole 312 and is welded into place. Once welding is complete, gasket 320 is placed against steel frame 316 and door frame 322 is placed against gasket 320 and steel frame 316. Threaded bolts 338 are passed through openings 334, 336, and 346 formed in steel frame 316, door frame 322, and gasket 320. Plates 290 of hinges 288 and striker housings 270 of latch mechanisms 268 are mounted to bolts 338 positioned at the desired locations for hinges 288 and striker housings 270, and nuts 344 are received by all bolts 338 and are tightened to provide sufficient force between steel frame 316 and door frame 322 to trap gasket 320 and form a watertight seal therebetween. An additional fiberglass layer 340 is applied to steel frame 316 and wall 314 adjacent to steel frame 314 on the inside of washer 300 to seal any undesired openings around bolts 338 and to prevent bolts 338 from being exposed to washing solution 99.

Finally, fiberglass door 200 is placed against door frame 322 to cover door-receiving opening 324. Rivets 299 are received by openings 294 of holders 292 of hinges 288 and by openings 298 of strap spools 296 of door-mounting assemblies 260 to pivotably mount fiberglass door 200 to door frame 322. In addition, latch mechanisms 268 engage striker (not shown) of striker housing 270 to retain fiberglass door 200 in the closed position having perimetral support flange 274 of fiberglass door 200 engaging door-sealing portion 258 of seal 254.

To move fiberglass door 200 away from the closed position, a user outside of washer 300 simply applies sufficient outwardly directed force to handle 220 to disengage latch 272 from striker (not shown), thereby allowing fiberglass door 200 to freely pivot about rivets 299. Likewise, a user inside of washer 300 applies sufficient outwardly directed force 273 to the inside of fiberglass door 200 to disengage latch 272 from striker.

Advantageously, fiberglass door 200 can be installed on fiberglass washers 12, it can replace fiberglass doors 200 on washers 300 made from materials other than fiberglass, and it can replace doors made from materials other than fiberglass of washers 300 made from materials other than fiberglass. Washers 12, 300 can be installed in various settings and fiberglass door 200 can be configured and installed with hinges 288 either on the left or on the right of fiberglass door 200 to accommodate the settings surrounding the washer 12, 300.

Although the invention has been described in detail with reference to a preferred embodiment, variations and modifications exist within the scope and spirit of the invention as described and defined in the following claims.

We claim:

1. A housing for an industrial finishing equipment station, the housing comprising a plurality of housing wall panels, each housing wall panel having a top edge, a bottom edge, and two spaced-apart sides therebetween, a flange appended to the top and side edges of each housing wall panel, the housing wall panels being positioned in two opposing rows and cooperating to define a tunnel-like passageway workspace therebetween through which work pieces can pass, and a clamp having flange-engaging portions mounted upon the flanges appended to the top edges of the housing wall panels to couple the housing wall panels together.

2. The housing of claim 1, wherein each housing wall panel includes a roof panel lying in a first plane and a bottom panel lying in a second plane, and the first plane and the second plane are not coplanar.

3. The housing of claim 2, wherein the roof panel, the side panel, and the flange are of unitary construction.

4. The housing of claim 3, wherein the housing wall panel is made from a plastic material.

5. The housing of claim 1, wherein the plurality of housing wall panels further includes a right-handed housing wall panel and an opposing left-handed housing wall panel arranged so that the flange adjacent to the top edge of the left-handed housing wall panel is positioned to lie adjacent to the flange adjacent to the top edge of the right-handed housing wall panel.

6. The housing of claim 5, wherein the housing further includes a drain board panel, each housing wall panel further includes a drain board-receiving portion adjacent to the bottom edge of the housing wall panel, and the drain board-receiving portion is appended to the drain board panel.

7. The housing of claim 6, wherein the station further includes a frame positioned below the housing and the drain board panel rests on the frame.

8. The housing of claim 1, wherein the housing further includes a silhouette panel appended to one of the housing wall panels and positioned to lie in orthogonal relation to the housing wall panel.

9. A housing for an industrial finishing equipment station including a conveyor rail, the housing comprising a plurality of housing wall panels, each housing wall panel having a top edge, a bottom edge, and two spaced-apart sides therebetween, a flange appended to the side edges of each housing wall panel, the housing wall panels being positioned in two opposing rows and cooperating to define a tunnel-like passageway workspace therebetween through which work pieces can pass, and means appended to the conveyor rail for clamping the housing wall panels to the conveyor rail without penetrating the housing wall panels.

10. The housing of claim 9, wherein each housing wall panel further includes a flange appended to the top edge of each housing wall panel and the clamping means includes a clamp bar having a flange-engaging portion arranged to engage the flange adjacent to the top edge of the housing wall panel, a conveyor rail-engaging portion, and means appended to the conveyor rail-engaging portion for fixing the clamp bar to the conveyor rail.

11. The housing of claim 10, wherein the conveyor rail is formed to include first fastener-receiving holes, the conveyor rail-engaging portion of the clamp bar is formed to include second fastener-receiving holes arranged to align with the first fastener-receiving holes, and threaded fasteners are received by the first and second fastener-receiving holes.

12. A housing for an industrial finishing equipment station including an elongated conveyor rail, the housing comprising a plurality of housing wall panels, each housing wall panel having a top edge, a bottom edge, and two spaced-apart sides therebetween, a flange appended to the side edges of each housing wall panel, the housing wall panels being positioned in two opposing rows and cooperating to define a tunnel-like passageway workspace therebetween through which work pieces ran pass, first and second external frame members positioned to lie in spaced-apart relation with the conveyor rail therebetween, and means connected to the external frame members for clamping the housing wall panels to the external frame members without penetrating the housing wall panels.

13. A housing for a station for use with industrial finishing equipment, the housing comprising a first housing wall panel having a planar roof panel having a top edge, a curved shoulder panel extending from the roof panel, a perimetral edge, and a flange appended to the top edge and the perimetral edge, second housing wall panel having a planar roof panel having a top edge, a curved shoulder panel extending from the roof panel, a perimetral edge, and a second flange appended to the top edge and the second perimetral edge, the top edge of the second housing wall panel being positioned to lie adjacent to the top edge of the first housing wall panel, and a fastener mechanism being coupled to the flanges appended to the top edges of the planar roof panels of the first and second housing wall panels to fix the first housing wall panel relative to the second housing wall panel, to position the first and second housing wall panels into two opposing rows, and to provide a workspace therebetween through which workpieces can pass.

14. A housing for an elongated station for use with industrial finishing equipment the housing comprising a first housing wall panel having a top edge a perimetral edge, and a flange appended to the perimetral edge, a second housing wall panel having a top edge, a perimetral edge, and a second flange appended to the second perimetral edge, the top edge of the second housing wall panel being positioned to lie adjacent to the top edge of the first housing wall panel, the station being arranged to define an elongated center between the first and second housing wall panels, means connected to the washer for fixing the first housing wall panel relative to the second housing wall panel to provide a workspace therebetween through which work pieces can pass, and an elongated mounting bar being arranged to extend through the center of the housing, and the first and second housing wall panels are appended to the mounting bar.

15. The housing of claim 14, wherein the industrial finishing equipment includes an elongated conveyor rail and the mounting bar is integrally appended to the conveyor rail.

16. The housing of claim 14, wherein the mounting bar includes an elongated first side and an elongated second side, and the flange adjacent to the top edge of the first housing wall panel engages the first side of the mounting bar and the flange adjacent to the top edge of the second housing wall panel engages the second side of the mounting bar.

17. The housing of claim 16, wherein the fixing means includes a first clamp bar appended to the first side of the mounting bar, the first clamp bar having a housing wall panel-engaging portion in engagement with the flange adjacent to the top edge of the first housing wall panel, and a second clamp bar appended to the second side of the mounting bar, the second clamp bar having a housing wall panel-engaging portion in engagement with the flange adjacent to the top edge of the second housing wall panel.

18. A housing for a station for use with industrial finishing equipment, the housing comprising a first housing wall panel having a top edge, a perimetral edge, and a flange appended to the perimetral edge, a second housing wall panel having a top edge, a perimetral edge, and a second flange appended to the second perimetral edge, the top of the second housing wall panel being positioned to lie adjacent to the top edge of the first housing wall panel, and means connected to the washer for fixing the first housing wall panel relative to the second housing wall panel to provide a workspace therebetween through which work pieces second can pass, and a first elongated frame member and a second elongated frame member arranged in spaced-apart relation to the first elongated frame member to define an elongated gap therebetween, and the first housing wall panel is connected to the first frame member and the second housing wall panel is connected to the second frame member.

19. The housing of claim 18, wherein the flange adjacent to the top edge of the first housing wall panel engages the first frame member and the flange adjacent to the top edge of the second housing wall panel engages the second frame member.

20. The housing of claim 19, wherein the fixing means includes a first clamp bar connected to the first frame member, the first clamp bar having a housing wall panel-engaging portion in engagement with the flange adjacent to the top edge of the first housing wall panel, and a second clamp bar connected to the second frame member, the second clamp bar having a housing wall panel-engaging portion in engagement with the flange adjacent to the top edge of the second housing wall panel.

21. The housing of claim 18, wherein the housing further includes first and second elongated rub bars disposed within the elongated gap, the first rub bar being appended to the top edge of the first housing wall panel and the second rub bar being appended to the top edge of the second housing wall panel, and the first and second rub bars being arranged in spaced-apart parallel relation to define a second elongated gap therebetween.

22. A housing for a station for use with industrial finishing equipment, the housing comprising a first housing wall panel having a top edge, a perimetral edge, a flange appended to the edge and the perimetral edge, and first and second spaced-apart sides, a second-housing wall panel having a top edge, a perimetral edge, a second flange appended to the second perimetral edge, and first and second spaced-part sides, the top edge of the second housing wall panel being positioned to lie adjacent to the top edge of the first housing wall panel and means for fixing the first housing wall panel relative to the second housing wall panel to provide a workspace therebetween through which work pieces can pass, a third housing wall panel having a top edge, a perimetral edge, a third flange appended to the perimetral edge, and first and second spaced-apart sides, the third housing wall panel being arranged in side-by-side relation to the first housing wall panel having the flange adjacent to the first side of the third housing wall panel appended to the flange adjacent to the second side of the first housing wall panel, and a fourth housing wall panel having a top edge, a perimetral edge, a flange appended to the perimetral edge, and first and second spaced apart sides, the fourth housing wall panel being arranged in side-by-side relation to the second housing wall panel having the flange adjacent to the first side of the fourth housing wall panel appended to the flange adjacent to the second side of the second housing wall panel.

23. A housing for a station installed in-line with industrial finishing equipment, the housing comprising a first housing wall panel including a top edge having a flange, a second housing wall panel including a top edge having a flange, the top edge of the second housing wall panel being positioned to lie adjacent to the top edge of the first housing wall panel and arranged so that the first and second housing wall panels cooperate to define a tunnel-like passageway workspace therebetween through which work pieces can move, and a fastener mechanism for fixing the flange on the top edge of the first housing wall panel relative to the flange on the top edge of the second housing wall panel without penetrating either one of the first and second housing wall panels.

24. The housing of claim 23, wherein the fixing means includes a first clamp bar in engagement with the first housing wall panel, and a second clamp bar in engagement with the second housing wall panel.

25. A housing for a station installed in-line with industrial finishing equipment, the housing comprising a first housing wall panel having a top edge, a flange having a clamp-engaging portion on a first side of the flange and a mounting bar-engaging portion on a second side of the flange, the flange being integrally appended to the first housing wall panel adjacent to the top edge, a second housing wall panel having a top edge and a flange having a clamp-engaging portion on a first side of the flange and a mounting bar-engaging portion on a second side of the flange, the flange being integrally appended to the second housing wall panel adjacent to the top edge, the top edge of the second housing wall panel being positioned to lie adjacent to the top edge of the first housing wall panel and arranged so that the first and second housing wall panels cooperate to define a tunnel-like passageway workspace therebetween through which work pieces can move, and means for fixing the first housing wall panel relative to the second housing wall panel without penetrating either one of the first and second housing wall panels, the fixing means including a first clamp bar in engagement with the first housing wall panel, and a second clamp bar in engagement with the second housing wall panel, and the first clamp bar engages the clamp-engaging portion of the first housing wall panel and the second clamp bar engages the clamp-engaging portion of the second housing wall panel.

26. The housing of claim 25, wherein the industrial finishing equipment further includes a conveyor rail and the housing further includes a mounting bar appended to the conveyor rail, the mounting bar having a first side and a second side, the mounting bar-engaging portion of the flange appended to the first housing wall panel engaging the first side of the mounting bar and the mounting bar-engaging portion of the flange appended to the second housing wall panel engaging the second side of the mounting bar.

27. The housing of claim 25, wherein the housing further includes first and second frame members, each frame member being formed to include a mounting bar, the mounting bar-engaging portion of the flange appended to the first housing wall panel engaging the mounting bar appended to the first frame member and the mounting bar-engaging portion of the flange appended to the second housing wall panel engaging the mounting bar appended to the second frame member.

28. A housing for a station installed in-line with industrial finishing equipment, the housing comprising a planar bottom panel having a top edge, a curved shoulder panel including a bottom edge and a top edge positioned to lie in spaced-apart parallel relation to the bottom edge of the shoulder panel, the bottom edge of the shoulder being appended to the top edge of the bottom panel, a planar roof panel having a bottom edge appended to the top edge of the shoulder panel and having a top edge and a flange appended to the top edge, and an opposing housing wall having a bottom side spaced apart from the bottom panel and art opposite top side having a flange thereon, the flange of the opposing housing wall being fixed relative to the flange of the roof panel.

29. The housing of claim 28, wherein each bottom panel is positioned to lie in a first plane, each roof panel is positioned to lie in a second plane, the first and second planes are not parallel, and the first and second planes are not perpendicular.

30. The housing of claim 29, wherein at least one bottom panel is formed to include two spaced-apart side edges, at least one shoulder is formed to include two spaced-apart side edges, and the roof panels are formed to include two spaced-apart side edges, the side edges of the bottom panel, the side edges of the shoulder, the side edges of the roof panel and the top edge of the roof panel cooperating to define a perimetral edge, and the housing further includes a flange appended to the perimetral edge.

31. The housing of claim 29, wherein the bottom panel, the shoulder, the roof panel, and the flange cooperate to define a housing wall panel of unitary construction.

32. The housing of claim 31, wherein the bottom panel, the shoulder, and the roof panel are opaque and the roof panel is formed to include a transparent window.

33. A washer for use with industrial finishing equipment, the washer comprising a frame, a tank having a top wall formed to include an upper lip appended to the frame, the tank being arranged to define an interior region that is generally disposed below the frame, a pipe having a proximal end disposed within the interior region and a distal end positioned outside of the interior region, the pipe including a wall arranged to define an interior hollow portion of the pipe in fluid communication with the interior region, a drain board having two spaced-apart sides and a perimeter outer edge engaging the upper lip of the tank, a first housing wall panel having a perimetral edge, a flange appended to the perimetral edge, and a bottom edge in engagement with the outer edge of the drain board, the first housing wall panel extending upwardly from the bottom edge, and a second housing wall panel having a perimetral edge, a flange appended to the perimetral edge, and a bottom edge in engagement with the outer edge of the drain board, the second housing wall panel extending upwardly from the bottom edge, the second housing wall panel being arranged to oppose the first housing wall panel, the first and second housing wall panels cooperating to define a tunnel-like passageway workspace therebetween through which work pieces can pass.

34. The housing of claim 33, wherein the first housing wall panel is of unitary construction and made from a plastic material, and the second housing wall panel is of unitary construction and is made from a plastic material.

35. A washer for use with industrial equipment, the washer comprising a frame, an elongated mounting bar, a tank having a top wall formed to include an upper lip appended to the frame, the tank being arranged to define an interior region that is generally disposed below the frame, a pipe having a proximal end disposed within the interior region and a distal end positioned outside of the interior region including a wall arranged to define an interior hollow portion of the pipe in fluid communication with the interior region, a drain board having two spaced-apart sides and a perimeter outer edge engaging the upper lip of the tank, a first housing wall edge, a flange construction and made from a plastic material having a perimetral edge, a flange appended to the perimetral edge of first housing wall panel and coupled to the mounting bar, and a bottom edge in engagement with the outer edge of the drain board, the first housing wall panel extending upwardly from the bottom edge, and a second housing wall panel of unitary construction and made from a plastic material having perimetral edge, a flange appended to the perimetral edge of second housing wall panel and coupled to the mounting bar, and a bottom edge in engagement with the outer edge of the drain board, the second housing wall panel extending upwardly from the bottom edge, the second housing wall panel being arranged to oppose the first housing wall panel, the first and second housing wall panels cooperating to define a tunnel-like passageway workspace therebetween through which work pieces can pass.

36. A housing for a station for use with industrial finishing equipment, the housing comprising an elongated mounting bar, a first housing wall panel having a top edge engaging the mounting bar, a second housing wall panel having a top edge engaging the mounting bar, the second housing wall panel being arranged to oppose the first housing wall panel, a tab appended to the first housing wall panel for stiffening the first housing wall panel so that the first housing wall panel requires no internal support frame, and a tab appended to the second housing wall panel for stiffening the second housing wall panel so that the second housing wall panel requires no internal support frame, and a fastener engaging the tab appended to the first housing wall panel and the tab appended to the second housing wall panel to fix the housing wall panels together.

37. A housing for a station for use with industrial finishing equipment, the housing comprising an elongated mounting bar, a first housing wall panel having a top edge engaging the mounting bar, a second housing wall panel having a top edge engaging mounting bar, the second housing wall panel being arranged to oppose the first housing wall panel, means appended to the first housing wall panel for stiffening the first housing wall panel so that the first housing wall panel requires no internal support frame, means appended to the second housing wall panel for stiffening the second housing wall panel so that the second housing wall panel requires no internal support frame, and means appended to the mounting bar for fixing the first and second housing wall panels to the mounting bar, the fixing means engaging the stiffening means appended to the first housing wall panel and the fixing means engaging the stiffening means appended to the second housing wall panel.

38. A housing for an in-line station for use with industrial finishing equipment having an elongated conveyor rail, the housing comprising a first housing wall panel having a bottom edge and a top edge appended to the conveyor rail, a second housing wall panel arranged to oppose the first housing wall panel, the second housing wall panel having a bottom edge and a top edge appended to the conveyor rail, a drain board panel positioned to lie beneath the first and second housing wall panels and arranged to engage the bottom edge of the first housing wall panel and the bottom edge of the second housing wall panel, the first housing wall panel, the second housing wall panel, and the drain board cooperating to define a tunnel-like workspace therebetween through which work pieces can pass, and means appended to the first housing wall panel and the second housing wall panel for stiffening the housing wall panels so that the first housing wall panel and the second housing wall panel are supported only along the top edges and the bottom edges of the housing wall panels.

39. A housing for enclosing a station for use with industrial finishing equipment, the housing comprising opposing housing wall panels cooperating to define a workspace therebetween through which workpieces can pass, each housing wall panel having a top edge, a bottom edge, and two spaced-apart sides therebetween, the top edges of opposing wall panels being fixed together and at least one housing wall panel being formed to include an inner edge defining a door-receiving opening, a door frame integrally appended to the inner edge and extending inwardly therefrom, and a flange appended to the edges of the panels and extending outwardly therefrom.

40. The housing of claim 39, wherein the door frame includes a support portion appended to the inner edge and extending inwardly in a direction perpendicular to the panel and surrounding the door-receiving opening and a sealing portion appended to the support portion and extending in a direction perpendicular to the support portion and toward a center of door-receiving opening, the sealing portion terminating at a second inner edge.

41. The housing of claim 40, further comprising a resilient seal mounted on the second inner edge of the sealing portion and a door pivotably connected to the panel and formed to include a perimetral support flange, the support flange sealingly engaging the seal when the door is in a closed position.

42. A housing for enclosing a station for use with industrial finishing equipment, the housing comprising a housing wall panel having a top edge, a bottom edge, and two spaced-apart sides therebetween, the panel being formed to include an inner edge defining a door-receiving opening, a door frame integrally appended to the inner edge and extending inwardly therefrom, a flange appended to the side edges of the panel and extending outwardly therefrom, a door, and means for mounting the door to one of the housing wall panels for pivotable movement relative to the housing wall panel, the door being formed to include a perimetral support flange, a door panel integrally appended to the support flange, and a raised portion integrally appended to the door panel, the raised portion having a top surface positioned to the flush with the housing wall panel.

43. The housing of claim 42, wherein the mounting means includes a hinge connected to the housing wall panel, the hinge including two spaced-apart holders, each holder being formed to include an opening therein, a strap connected to the top surface, the strap including a strap spool formed to include a cylindrical opening, the strap spool being received between the holders, and a rivet engaging the strap spool and the holders and received by the openings of the holders and the cylindrical opening of the strap spool.

44. The housing of claim 43, wherein the strap is bolted to the top surface, the bolts include heads that are positioned to lie inside of the housing, and the housing further comprises a layer on the inside of the housing covering the heads of the bolts.

* * * * *